United States Patent [19]

Okumura et al.

[11] Patent Number: 4,517,033

[45] Date of Patent: May 14, 1985

[54] CONTACT MATERIAL FOR VACUUM CIRCUIT BREAKER

[75] Inventors: Mitsuhiro Okumura, Sakai; Eizo Naya, Ibaragi; Michinosuke Demizu, Takarazuka, all of Japan

[73] Assignee: Mitsubishi Denki Kabushiki Kaisha, Tokyo, Japan

[21] Appl. No.: 547,218

[22] Filed: Oct. 31, 1983

[30] Foreign Application Priority Data

| | | | |
|---|---|---|---|
| Nov. 1, 1982 | [JP] | Japan | 57-192785 |
| Apr. 28, 1983 | [JP] | Japan | 58-76615 |
| Apr. 28, 1983 | [JP] | Japan | 58-76616 |
| Apr. 28, 1983 | [JP] | Japan | 58-76617 |

[51] Int. Cl.[3] ..... C22C 9/00; C22C 30/02

[52] U.S. Cl. ..... 148/432; 148/436; 148/442; 420/489; 420/492; 420/495; 420/497; 420/500; 420/587; 420/588; 200/266

[58] Field of Search ..... 420/469, 580, 587, 588, 420/488, 497, 492, 495, 499, 500; 148/432, 436, 442; 200/266

[56] References Cited

U.S. PATENT DOCUMENTS

| | | | |
|---|---|---|---|
| 2,218,073 | 10/1940 | Schwarzkopf | 420/495 |
| 2,281,691 | 5/1942 | Hensel et al. | 148/432 |
| 4,007,039 | 2/1977 | Shapiro et al. | 148/432 |
| 4,008,081 | 2/1977 | Hundstad | 420/495 |

FOREIGN PATENT DOCUMENTS

| | | | |
|---|---|---|---|
| 9294 | 3/1974 | Japan | 420/492 |
| 22345 | 2/1983 | Japan | 420/469 |
| 2106141 | 7/1983 | United Kingdom | 148/432 |

*Primary Examiner*—L. Dewayne Rutledge
*Assistant Examiner*—Christopher W. Brody
*Attorney, Agent, or Firm*—Oblon, Fisher, Spivak, McClelland & Maier

[57] ABSTRACT

A contact material for a vacuum circuit breaker consists essentially of copper as the basic component, and, as the other components, 35% by weight or below of chromium and 50% by weight or below of tantalum, the total quantity of chromium and tantalum in said contact material being 10% by weight and above.

20 Claims, 19 Drawing Figures

CONTACT MATERIAL FOR VACUUM CIRCUIT BREAKER

This invention relates to a contact material for a vacuum circuit breaker which is excellent in large current breaking property and high voltage withstand capability.

The vacuum circuit breaker has various advantages such that it is free from maintenance, does not bring about public pollution, is excellent in its current breaking property, and so forth, hence the extent of its applications has become widened very rapidly. With this expansion in its utility, demands for higher voltage withstand property and larger current breaking capability of the vacuum circuit breaker have become increasingly high. On the other hand, the performance of the vacuum circuit breaker depends to a large extent on the element to be determined by the contact material placed within a vacuum container for the vacuum circuit breaker.

For the characteristics of the contact material for the vacuum circuit breaker to satisfy, there may be enumerated: (1) large current breaking capacity; (2) high voltage withstand; (3) small contact resistance; (4) small melt-adhesion; (5) low consumption rate of the contact; (6) small breaking current; (7) good workability; (8) sufficient mechanical strength; and so forth.

In the actual contact material, it is fairly difficult to satisfy all of these characteristics, and general circumstances at the present are such that use is made of a material which meets particularly important characteristic depending on its utilization at the sacrifice of other characteristics to some extent.

There have so far been used as this kind of the contact material a copper-bismuth alloy (hereinafter simply indicated as "Cu-Bi"; for other elements and alloys made up of combination of those elements will also be indicated by the elemental symbols in the same manner as above), Cu-Cr-Bi, Cu-Co-Bi, Cu-Cr, and others. However, with the alloy contact such as Cu-Bi, etc. containing therein a low melting point metal, a part of the metal in the alloy component diffuses and evaporates from the contact to adhere to the metal shield and the insulative container in the vacuum vessel. This adhesion of the evaporated metal constitutes one of the serious causes for deteriorating the voltage withstand of the vacuum circuit breaker. The evaporation and scattering of the low melting point metal also take place even at the time of opening and closing of a load and large current breaking, whereby there are observed deterioration in the voltage withstand and lowering in the current breaking capability. Even with Cu-Cr-Bi alloy having chromium and cobalt excellent in the voltage withstand in the vacuum added to the alloy with a view to eliminating the abovementioned disadvantages, such disadvantages as mentioned above due to the low melting point metal cannot be solved perfectly, hence the vacuum circuit breaker is not able to withstand high voltage and large current. On the other hand, an alloy material such as Cu-Cr, etc. consisting of a metal (such as Cr, Co, etc.) excellent in the vacuum voltage withstand and Cu excellent in the electrical conductivity in combination is superior in its current breaking and voltage withstand capabilities, though somewhat inferior to the contact material containing the low melting point metal as to its anti-welding capability, hence it has been well utilized in the high voltage and large current region. Further, the Cu-Cr alloy has its own limitation in the current breaking capability, on account of which efforts have been made as to increasing the current breaking capability by contriving the shape of the contact and manipulating the current path at the contact part to generate the magnetic field and compulsorily drive the large current arc with the force of the magnetic field.

However, since the demands for higher voltage withstand and larger current breaking capabilities of the vacuum circuit breaker have become increasingly high, it is now difficult to attain satisfactorily the performances as demanded with the conventional contact material; likewise, the capabilities of the conventional contact material are not sufficient for the size-reduction of the vacuum circuit breaker, so that the contact material having more excellent capabilities have been sought for.

In view of the above-described various shortcoming inherent in the conventional vacuum circuit breaker, it is the primary object of the present invention to provide a contact material for the vacuum circuit breaker which is excellent in the large current breaking characteristics and has high voltage withstand capability.

With a view to achieving the abovementioned object, the present inventors experimentally prepared the contact materials, in which various sorts of metals, alloys and intermetallic compounds were added to copper and each of these contact materials was assembled in the vacuum circuit breaker to conduct various experiments. The results of the experiments revealed that those contact materials, in which copper, chromium and tantalum are distributed in the base material as a single substance or at least one kind of an alloy of these three metals, alloys of two of these metals, an intermetallic compound of these three metals, intermetallic compounds of two of these metals, and a composite body of these, are very excellent in the current breaking capability.

Moreover, it has been found out that the contact material also indicates very excellent current breaking capability and favorable voltage withstand capability, even when an adding quantity of tantalum, a generally expensive material, is reduced in the contact material made up of Cu, Cr and Ta as the principal constituents and Ti or Al or Zr is added thereto in a small quantity so as to save such expensive metal as much as possible and to improve effectively the current breaking capability.

According to the present invention, in one aspect of it, there is provided a contact material for a vacuum circuit breaker which consists essentially of copper as the basic component, and, as other components, 35% by weight or below of chromium and 50% by weight or below of tantalum, the total quantity of chromium and tantalum in said contact material being 10% by weight or above.

According to the present invention, in another aspect of it, there is provided a contact material for a vacuum circuit breaker which consists essentially of copper as the basic component, and, as other components, 10 to 35% by weight of chromium and 20% by weight or below of tantalum, and, as additives in a small quantity, 5% by weight or below of titanium, or 3% by weight or below of aluminum, or 2% by weight or below of zirconium.

The foregoing object, other objects as well as specific constituent elements, mixing ratio of these constituent elements, and the effects to be derived therefrom of the contact material according to the present invention will become more apparent and understandable from the following detailed description and specific examples thereof, when read in conjunction with the accompanying drawing.

Figure 14:
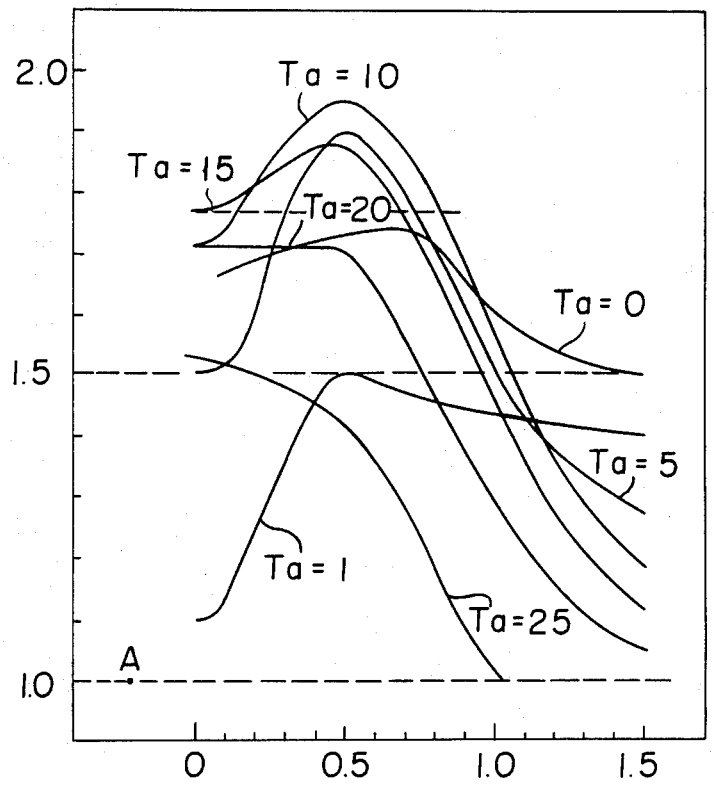
Figure 15:
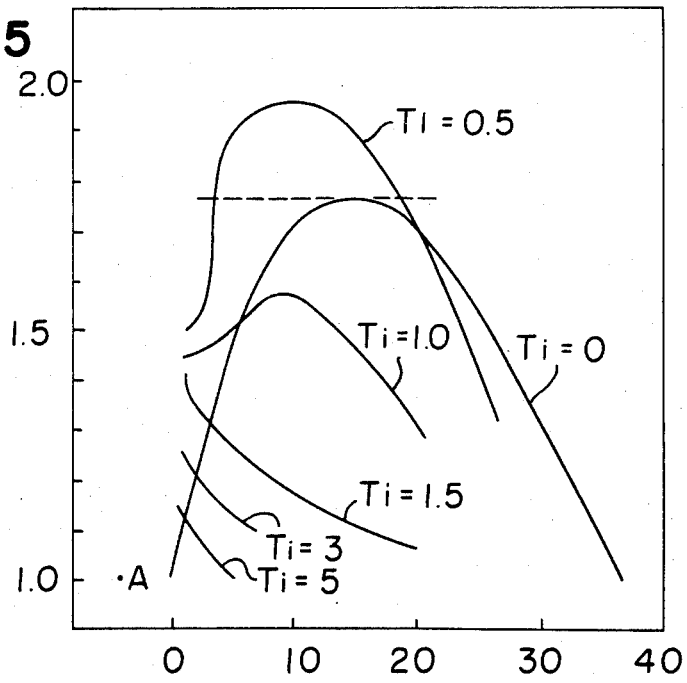
Figure 16:
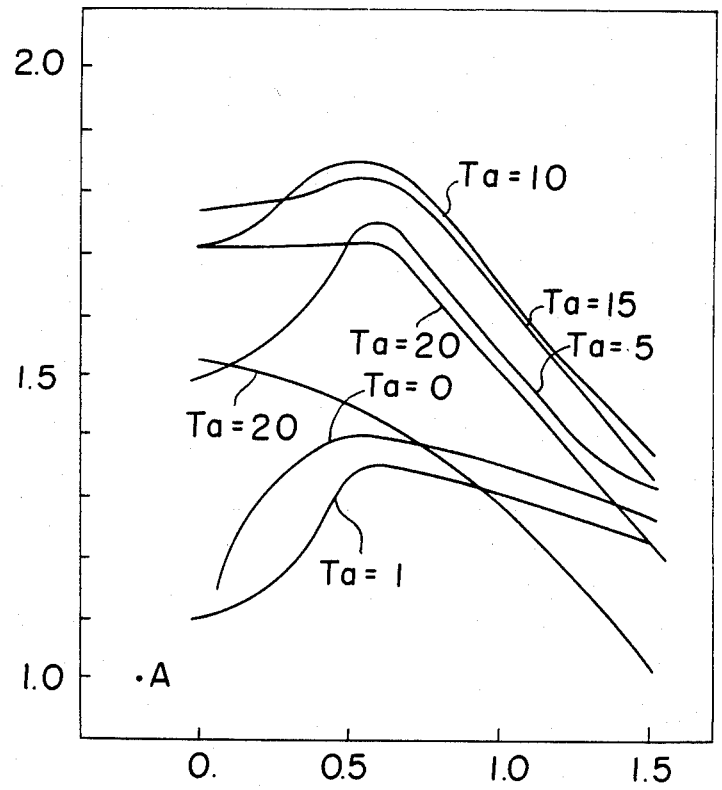
Figure 17:
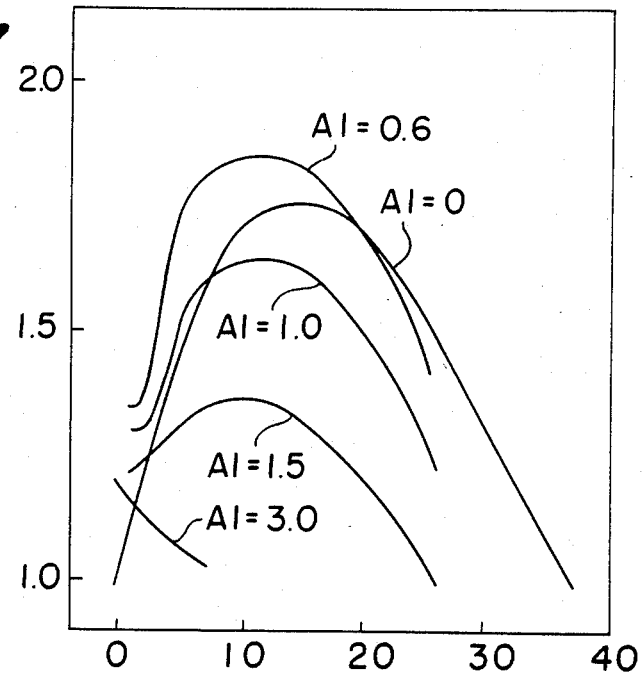
Figure 18:
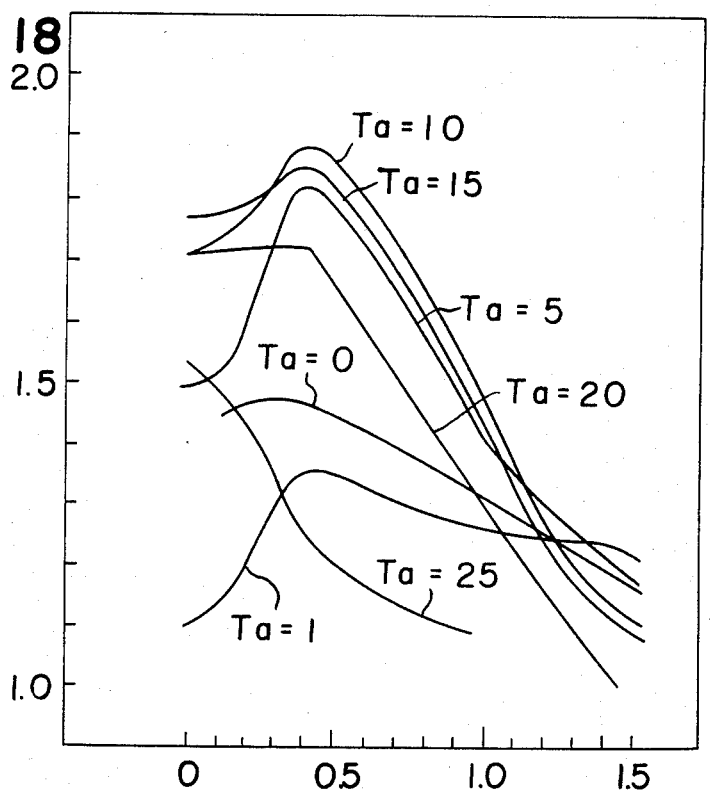
Figure 19:
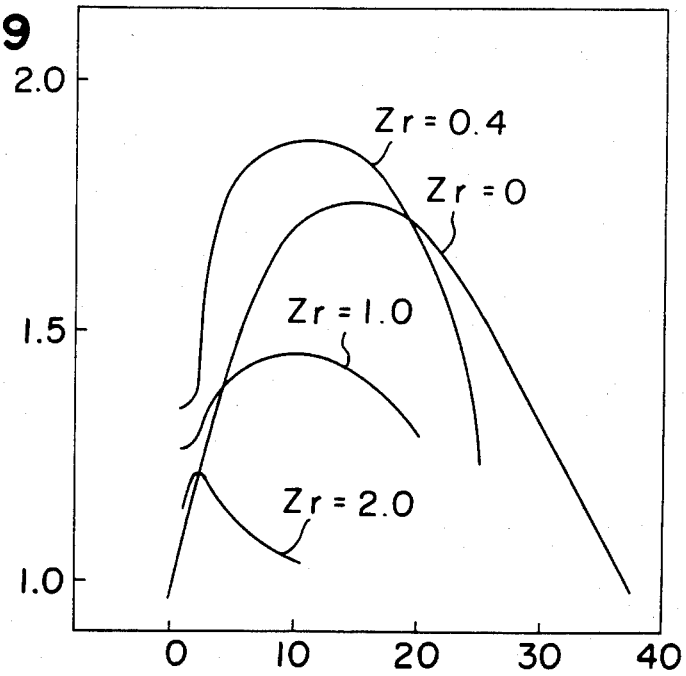

FIG. 14 is a characteristic diagram showing variations in the current breaking capacity of the contact material according to the second embodiment of the present invention, when the adding quantity of titanium is varied with respect to the alloy of the contact material, in which the quantity of chromium is fixed at 25% by weight and the quantity of tantalum is fixed at 0, 1, 5, 10, 15, 20 and 25% by weight, respectively;

FIG. 15 is a characteristic diagram showing variations in the current breaking capacity of the contact material according to the second embodiment of the present invention, when the quantity of tantalum is varied with respect to the alloy of the contact material, in which the quantity of chromium is fixed at 25% by weight and the quantity of titanium is fixed at 0, 0.5, 1.0, 1.5, 3 and 5% by weight, respectively;

FIG. 16 is a characteristic diagram showing variations in the current breaking capacity of the contact material according to the third embodiment of the present invention, when the adding quantity of alumium is varied with respect to the alloy of the contact material, in which the quantity of chromium is fixed at 25% by weight and the quantity of tantalum is fixed at 0, 1, 5, 10, 15, 20 and 25% by weight, respectively;

FIG. 17 is a characteristic diagram showing variations in the current breaking capacity of the contact material according to the third embodiment of the present invention, when the quantity of tantalum is varied with respect to the alloy of the contact material, in which the quantity of chromium is fixed at 25% by weight and the quantity of aluminum is fixed at 0, 0.6, 1.0, 1.5, 3.0% by weight, respectively;

FIG. 18 is a characteristic diagram showing variations in the current breaking capacity of the contact material according to the fourth embodiment of the present invention, when the adding quantity of zirconium is varied with respect to the alloy of the contact material, in which the quantity of chromium is fixed at 25% by weight and the quantity of tantalum is fixed at 0, 1, 5, 10, 15, 20 and 25% by weight, respectively; and FIG. 19 is a characteristic diagram showing variations in the current breaking capacity of the contact material according to the fourth embodiment of the present invention, when the quantity of tantalum is varied with respect to the alloy of the contact material, in which the quantity of chromium is fixed at 25% by weight and the quantity of zirconium is fixed at 0, 0.4, 1.0 and 2.0% by weight, respectively.

In the following, the present invention will be described in detail in reference to several preferred embodiments thereof shown in the accompanying drawing.

Figure 1:
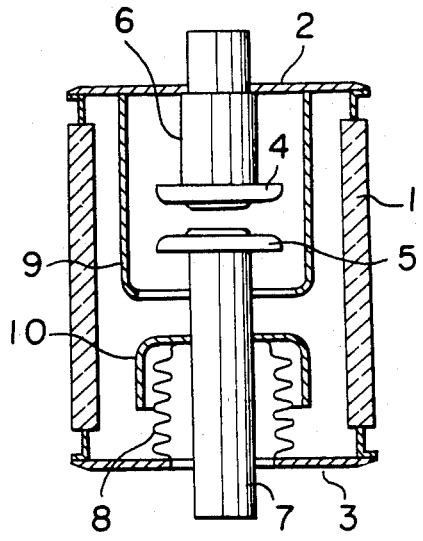
FIG. 1 is a longitudinal cross-sectional view showing a structure of a vacuum switch tube according to a preferred embodiment of the present invention.
Figure 2:
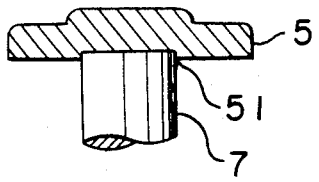
FIG. 2 is an enlarged cross-sectional view of an electrode portion shown in FIG. 1.

Referring first to FIG. 1 showing the first embodiment of the present invention, which is a construction of a vacuum switch tube, wherein electrodes 4 and 5 are disposed at one end of respective electrode rods 6 and 7 in a manner to be opposed each other in the interior of a container formed by a vacuum insulative vessel 1 and end plates 2 and 3 for closing both ends of the vacuum insulative vessel 1. The electrode rod 7 is joined with the end plate 3 through a bellow 8 in a manner not to impair the hermetic sealing of the container and to be capable of its axial movement. Shields 9 and 10 cover the inner surface of the vacuum insulative vessel 1 and the bellow 8 so as not to be contaminated with vapor produced by the electric arc. FIG. 2 illustrates the construction of the electrodes 4 and 5. The electrode 5 is soldered on its back surface to the electrode rod 7 with a soldering material 51. The electrodes 4 and 5 are made of a contact material of Cu-Cr-Ta series alloy according to the present invention.

Figure 3:
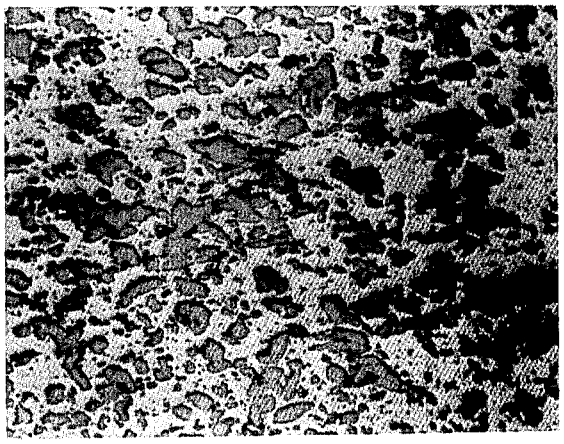
FIG. 3 is a micrograph in the scale of 100 magnification showing a microstructure of a conventional Cu-Cr alloy for the contact material containing 25% by weight of chromium and manufactured by the sintering method.

FIG. 3 is a micrograph in the scale of 100 magnification showing a microstructure of a conventional Cu-Cr alloy contact material, as a comparative example. The Cu-Cr alloy is obtained by mixing 75% by weight of copper powder and 25% by weight of chromium powder, shaping the mixture, and sintering the thus shaped body.

Figure 4:
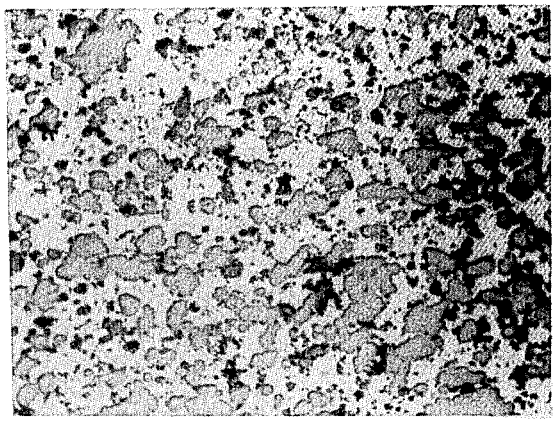
FIG. 4 is also a micrograph in the scale of 100 magnification showing a microstructure of an alloy for the contact material according to the first embodiment of the present invention, in which 10% by weight of tantalum is added to a mother alloy consisting of copper and 25% by weight of chromium, and sintered at a high temperature.

FIG. 4 is a micrograph in the scale of 100 magnification showing a microstructure of Cu-Cr-Ta alloy contact material according to the first embodiment of the present invention. The Cu-Cr-Ta alloy is obtained by mixing 75% by weight of copper powder and 25% by weight of chromium powder, to which mixture powder 10% by weight of tantalum is added, shaping the mixture, and sintering the thus shaped body. Incidentally, the sintering is done at a temperature of 1,100° C. or so, wherein chromium and a part of tantalum react to form $Cr_2Ta$.

Figure 5:
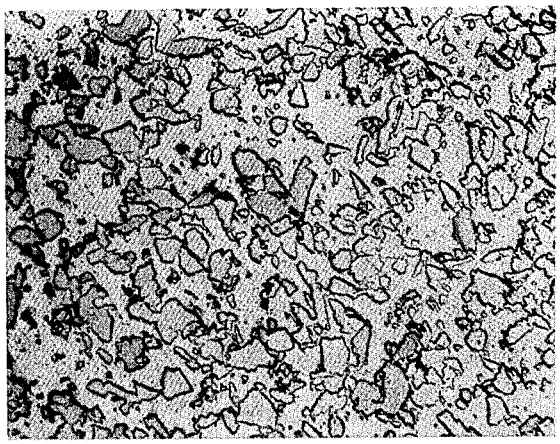
FIG. 5 is a micrograph in the scale of 100 magnification showing a microstructure of an alloy for the contact material according to a modification of the first embodiment of the present invention, having the same composition as the alloy of FIG. 4, but having been sintered at a low temperature.

FIG. 5 is a micrograph in the scale of 100 magnification showing a microstructure of a Cu-Cr-Ta alloy according to a modification of the first embodiment, wherein the alloy is sintered at a relatively low temperature level such that chromium and tantalum are difficult to form an alloy or an intermetallic compound. The alloy is obtained by shaping band sintering the mixture of Cu, Cr and Ta metal powder of the same mixing ratio as in the embodiment shown in FIG. 4. It is seen that the alloy of FIG. 4 has Cr, Ta and $Cr_2Ta$ distributed uniformly and minutely in Cu as the basic constituent. Further, the alloy of FIG. 5 has Cr and Ta distributed in Cu mainly as a single metal substance, in which $Cr_2Ta$ can hardly found.

In the following, explanations will be made as to the results of various measurements or experiments done.

First of all, from the experimental results of the present inventors, the binary alloy of Cu and Cr for the contact material has proved to be very excellent in its various capailities, when the contact of Cr therein is in a range of from 20 to 30% by weight. FIGS. 6 to 9 show variations in those characteristics of the alloy for the contact material, wherein the weight ratio between Cu and Cr is maintained at a constant and fixed ratio (75:25) and the amount of Ta to be added thereto is made variable.

Figure 6:
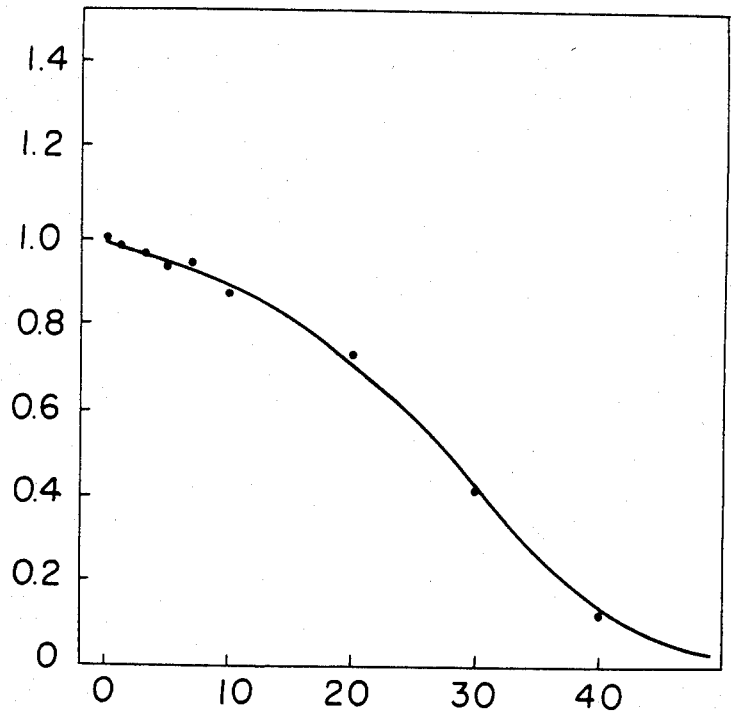
FIG. 6 is a characteristic diagram showing variations in the electrical conductivity of the contact material according to the first embodiment of the present invention, when the adding quantity of tantalum is varied with respect to the alloy of the contact material, in which the weight ratio of chromium to copper is fixed at 25:75.

FIG. 6 shows a relationship between the electrical conductivity and the amount of Ta added to the alloy, wherein the weight ratio between Cu and Cr is fixed at 75:25. From the graphical representation, it is seen that the electrical conductivity lowers with increase in the amount of Ta added. In the case of the fixed weight ratio between Cu and Cr in the alloy of 75:25, the adding quantity of Ta may be varied depending on the purpose of use of the alloy, although, in particular, the amount should desirably be upto 30% by weight.

Incidentally, the ordinate in the graph of FIG. 6 denotes a ratio when the electrical conductivity of a conventional alloy (Cu-25 wt. % Cr) is made 1, and the abscissa denotes the adding quantity of Ta.

Figure 7:
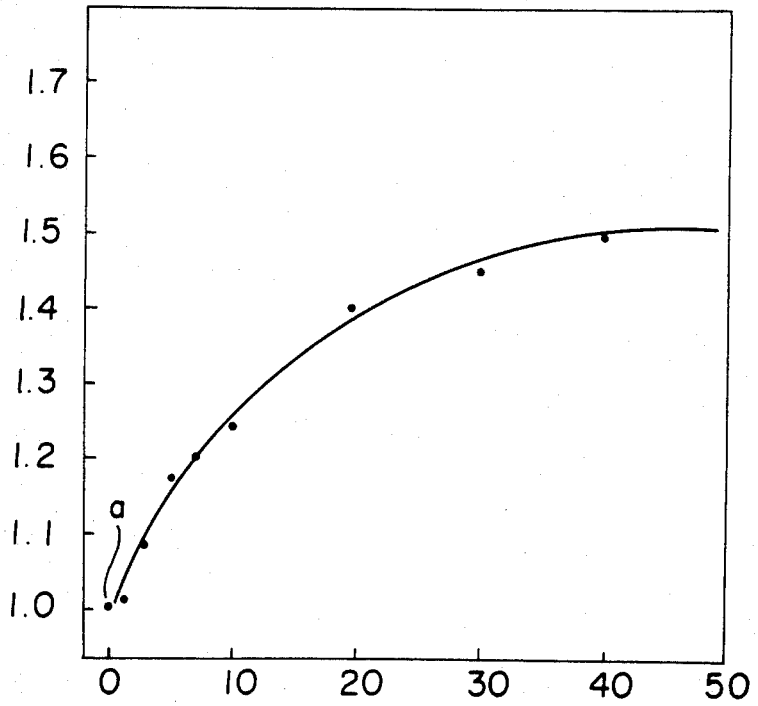
FIG. 7 is also a characteristic diagram showing variations in the contact resistance of the contact material according to the first embodiment of the present invention, when the adding quantity of tantalum is varied with respect to the alloy of the contact material, in which the weight ratio of chromium to copper is fixed at 25:75.

FIG. 7 shows a relationshiop between the contact resistance and a quantity of Ta added to the alloy for the contact material, wherein the weight ratio between Cu and Cr is fixed at 75:25. The graph shows a similar tendency to the electrical conductivity. By the way, the ordinate in the graph of FIG. 7 denotes a ratio when the electrical conductivity value of a conventional alloy a consisting of Cu and 25% by weight of Cr is made 1.

Figure 8:
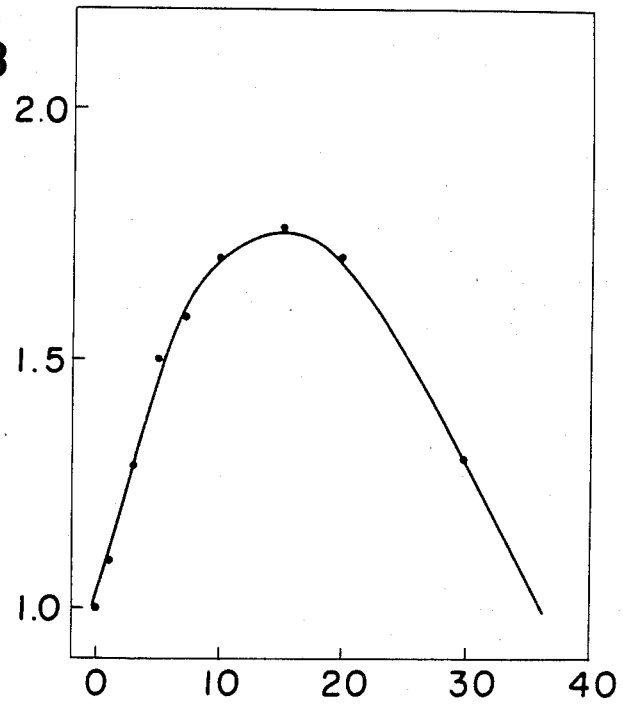
FIG. 8 is a characteristic diagram showing variations in the current breaking capacity of the contact material according to the first embodiment of the present invention, when the adding quantity of tantalum is varied with respect to the alloy of the contact material, in which the weight ratio of chromium to copper is fixed at 25:75.

FIG. 8 indicatres a relationship between the current breaking capacity and an amount of Ta added to the alloy, in which the weight ratio between Cu and Cr is fixed at 75:25. It is seen from this graphical representation that the alloy added with Ta has a remarkably increased current breaking capability in comparison with the conventional alloy (Cu-25% by weight Cr).

By the way, the ordinate in the graph of FIG. 8 shows a ratio when the electrical conductivity value of the conventional alloy a consisting of Cu and 25 wt. % Cr is made 1. As is apparent from FIG. 8, with increase in the adding quantity of Ta, the current breaking capacity of the alloy augments. It reaches 1.7 times as high as that of the conventional alloy with the added quantity of Ta of 10% by weight, and reaches the peak at the added Ta quantity of 15% by weight or so. When more quantity of Ta than above is added, the current breaking capacity decreases conversely. The reason for this is that, while the current breaking capability can be increased by the mutual action of the coexisting Ta and Cr in the alloy, any further increase in the quantity of Ta and Cr in the alloy causes decrease in the amount of Cu having good electrical conductivity to lower the electrical conductivity and heat conductivity of the alloy, thereby making it difficult to quickly dissipate the heat input due to electric arc and deteriorating the current breaking capability inversely.

Figure 9:
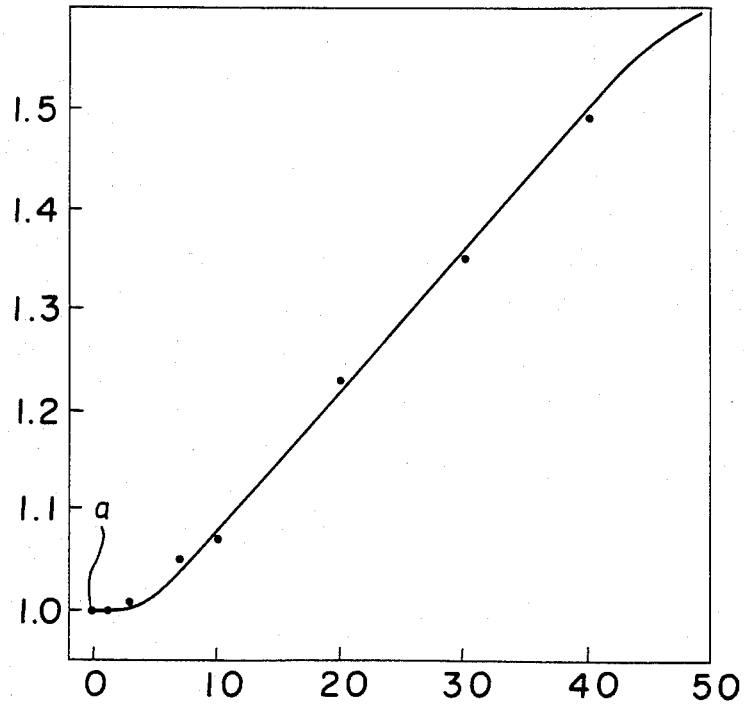
FIG. 9 is a characteristic diagram showing variations in the voltage withstand capability of the contact material according to the first embodiment of the present invention, when the adding quantity of tantalum is varied with respect to the alloy of the contact material, in which the weight ratio of chromium to copper is fixed at 25:75.

FIG. 9 shows a relationship between the voltage withstand capability and the adding quantity of Ta. As is apparent from the graphical representation, the difference in the voltage withstand capability of the alloy of the invention and the conventional alloy a (Cu-25 wt. % Cr) is slight with the added Ta quantity of 5% by weight and below. With increase in its adding quantity, however, the voltage withstand capability is seen to rise. In general, when the total weight percent of Cr and Ta increases, the voltage withstand capability tends to improve.

In the following, variations in the characteristics of the alloy are shown, wherein the weight ratio of Cr to Cu is varied in the alloy, in which the quantity of Ta is fixed at 30% by weight.

Figure 10:
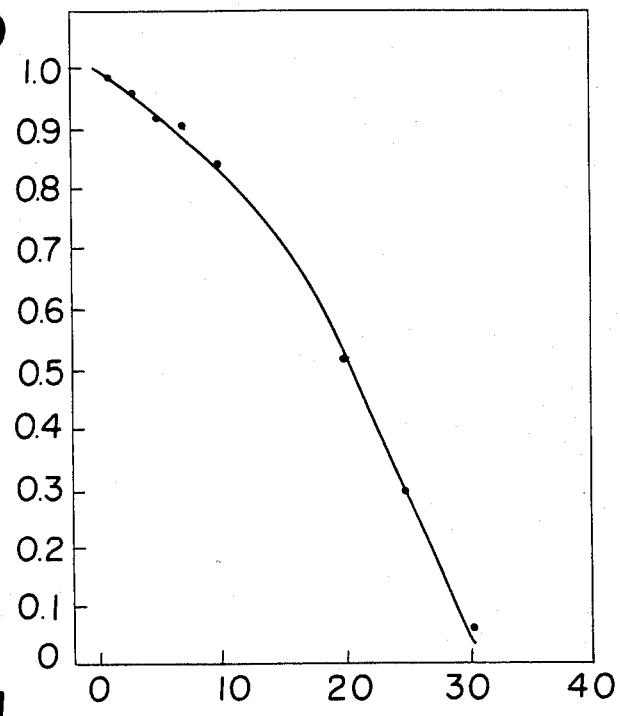
FIG. 10 is a characteristic diagram showing variations in the electrical conductivity of the contact material according to the first embodiment of the present invention, when the weight ratio of chromium to copper in the alloy of the contact material is varied, and the quantity of tantalum in the alloy is fixed at 30% by weight.

FIG. 10 indicates a relationship between the electrical conductivity and the weight ratio of Cr to Cu.

Figure 11:
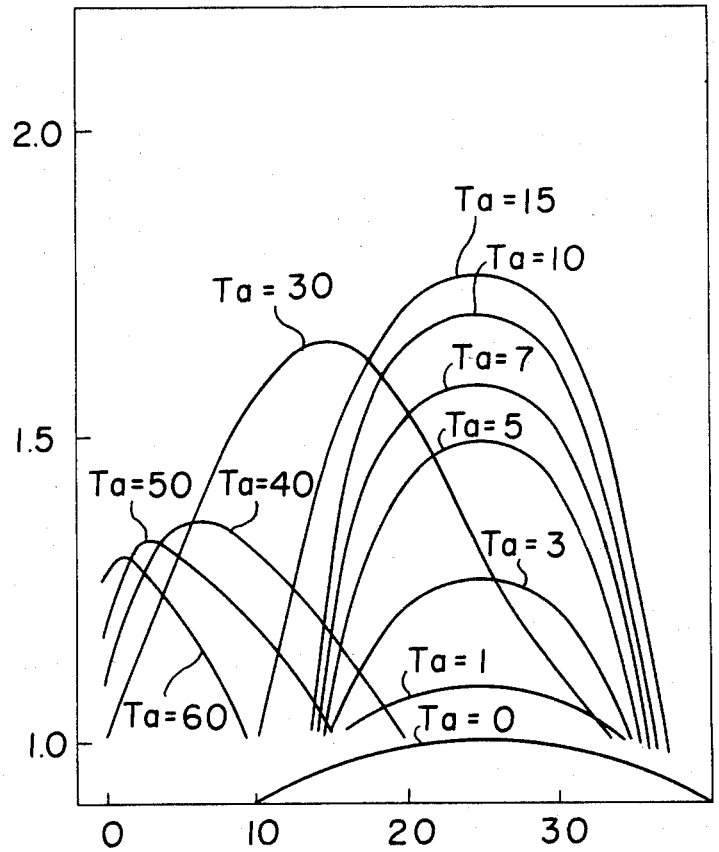
FIG. 11 is a characteristic diagram showing variations in the current breaking capacity of the alloy of the contact material according to the first embodiment of the present invention, when the weight ratio of chromium to copper is varied, and the quantity of tantalum is fixed at 0, 1, 3, 5, 7, 10, 15, 30, 40, 50 and 60% by weight, respectively.

FIG. 11 shows a relationship between the current breaking capability and the weight ratio of Cr, when the adding quantity of Ta to the alloy is fixed at 0, 1, 3, 5, 7, 10, 15, 30, 40, 50 and 60% by weight, respectively, and the weight ratio of Cr to Cu is varied in each alloy of the abovementioned Ta content. In the graphical representation, the ordinate represents a ratio when the current breaking capacity value of the conventional alloy a (Cu-25 wt. % Cr) is made 1, and the abscissa denotes the weight ratio of Cr to Cu. As seen from the graphical representation, the conventional alloy a (Cu-Cr binary alloy) indicates a peak in its current breaking capacity with the Cr content being in a range of from 20 to 30% by weight. A similar tendency is observed when the Ta content is fixed at 1 to 15% by weight. When the Ta content is fixed at 15% by weight, there is observed remarkable increase in the current breaking capability with the weight ratio of Cr to Cu being in a range of from 10% by weight or so (8.5% by weight with respect to the whole contact material) to 25% by weight or so (21.3% by weight with respect to the whole contact material). On the other hand, when the Ta content is fixed at 30% by weight, the peak of the current breaking capacity appears at the weight ratio of Cr to Cu being in a range of from 10 to 20% by weight (7 to 14% by weight with respect to the whole contact material), the peak value of which is somewhat inferior to the alloy of the Ta content of 15% by weight.

Figure 12:
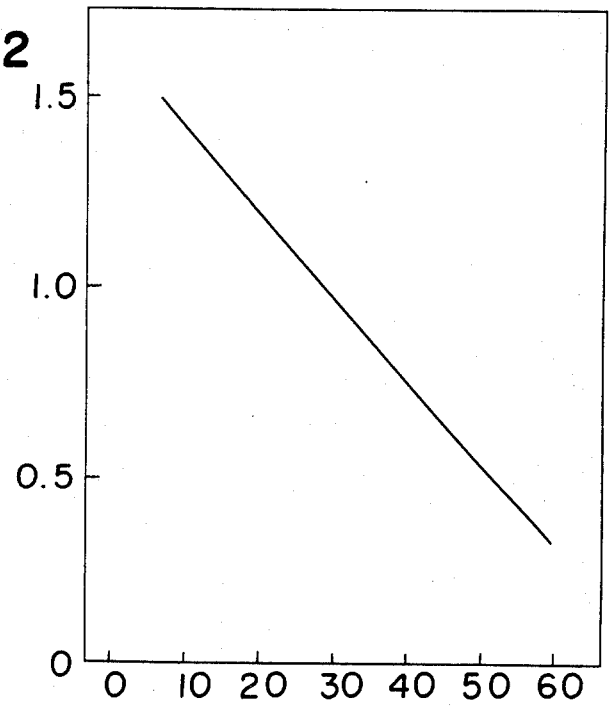
FIG. 12 is a characteristic diagram showing, for the purpose of reference, relationship between the quantity of tantalum and the electrical conductivity in a Cu-Ta binary alloy.
Figure 13:
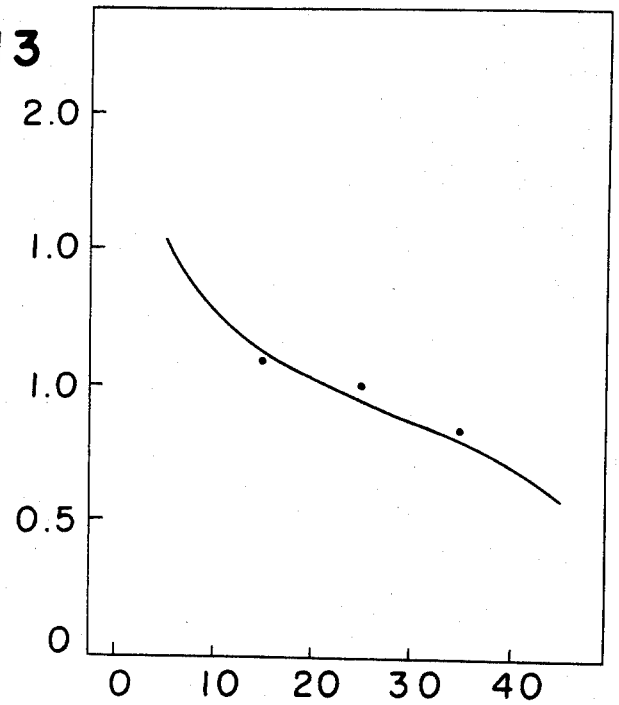
FIG. 13 is a characteristic diagram showing, for the purpose of reference, a relationship between the quantity of chromium and the electrical conductivity in a Cu-Cr binary alloy.

FIG. 12 shows a relationshipo between the electrical conductivity and the Ta content in the binary alloy of Cu and Ta, and FIG. 13 indicates a relationship betweeen the electrical conductivity and the Cr content in the binary alloy of Cu and Cr. It will be seen from both graphical representations that, as each of Ta and Cr increases, the electrical conductivity lowers, and the electrical conductivity required generally of the contact for the current breaking reaches the limit with the Ta content of 50% by weight or so and with the Cr content of 40% by weight or so, beyond which content of Ta and Cr, there emerge practical mal-effects from the standpoints of electrical conduction, current breaking, and so on. As is apparent from FIG. 11 in the co-presence of Ta and Cr, there is observed improvement in the curent breaking capability with the Cr content of 35% by weight or below with respect to the whole contact material, and no effect can be obtained when the Cr content is increased further. On the other hand, from the aspect of Ta, the improvement is seen in the current breaking capability by addition of even a small quantity of Ta, owing to its coexistence with Cr. A practical Ta content may be 50% by weight or below. Incidentally, it seems that, even in the Ta content of 50% by weight or above, there is an effective range from the standpoint of the current breaking capability. The alloy of this figure of the Ta content, however, is difficult to be realized for the practical purpose, except for the circuit breaker of a particular use, because such alloy is difficult to be obtained by an ordinary sintering method and, as is apparent from FIG. 12, with the Ta content of 50% by weight and above, the electrical conductivity becomes low and the contact resistance becomes high.

Furthermore, from FIG. 11, a range of the weight ratio of the constituent elements in the alloy, wherein the current breaking capability remarkably increases (exceeding 1.5 times) in comparison with the conventional alloy, should desirably be 5 to 30% by weight of Ta and 8 to 33% by weight of Cr to Cu (that is, $8\times0.7=5$ to $33\times0.9=30\%$ by weight with respect to the whole contact material).

Further, from the graphical representation in FIG. 11, the alloy showed its effect of the current breaking capability with the total content of Cr and Ta being 10% by weight or above with respect to the whole contact material. With the total content of less than 10% by weight, there could be observed no improvement in the current breaking capability. On the contrary, as seen from the graphical representation in FIG. 11, when the total content of Cr and Ta with respect to whole contact material becomes gradually increased, the manufacture of the alloy becomes difficult, and, with the total content of 65% by weight and above, satisfactory current breaking capability can no longer be expected, though depending on the manufacturing method.

By the way, the abovementioned experimental examples of FIGS. 6 through 11 indicate various characteristics of the alloys, in which Cr, Ta and $Cr_2Ta$ are uniformly and finely distributed in Cu ($Cr_2Ta$ being an intermetallic compound consisting of Cr and Ta). It should, however, be noted that, even the alloy obtained from a lower sintering temperature and in which Cu, Cr and Ta are distributed almost in the form of single substance exhibits substantially same tendency as mentioned above, and has a remarkably large current breaking capability in comparison with the conventional alloy (consisting of Cu-25 wt. % Cr). On the other hand, however, it has also been found that the Cu-Cr-Ta alloy obtained by mixing the same constituent elements at the same ratio as mentioned above, shaping the mixture, and sintering the shaped material is excellent in its current breaking capability, if the intermetallic compound of Cr and Ta has been formed in it.

Moreover, though not shown in the drawing, it has also been verified that even a contact for a low chopping, vacuum circuit breaker obtained from the abovementioned alloy which is added with 20% by weight or below of at least one kind of low melting point metals such as Bi, Te, Sb, Tl, Pb, Se, Ce and Ca, alloys of these metals, and intermetallic compounds of these metals has the effect of increasing the current breaking capability and the voltage withstand capability same as the abovementioned experimental examples.

When at least one of those low melting point metals, their alloys and their intermetallic compounds is added to the alloy for the contact material at a rate of 20% by weight or above, the current breaking capability remarkably lowered. Also, when the low melting point metal is Ce or Ca, the characteristics of the alloy dropped to some extent.

As explained in the foregoing, the contact material according to this first embodiment of the present invention is characterized by containing copper and, as the other components, 35% by weight or below of chromium and 50% by weight or below of tantalum, the total content of chromium and tantalum being in a range of 10% by weight and above, the alloy composition of which exhibits excellent current breaking capability and high voltage withstand capability.

In the following, the second embodiment of the present invention will be explained. In this second embodiment, a Cu-Cr-Ta-Ti series alloy is used as the contact material for the electrodes 4 and 5 shown in FIG. 1.

FIG. 14 indicates a relationship between the current breaking capacity and the Ti content added to the alloy for the contact material, wherein the Cr content is fixed at 25% byd weight, and the Ta content is fixed at 0, 1, 5, 10, 15, 20 and 25% by weight, respectively. In the graphical representation in FIG. 14, the ordinate represents a ratio when the current breaking capacity of the conventional alloy (consisting of Cu-25 Cr) is made 1, and the abscissa denotes the adding quantity of Ti. In FIG. 14, a reference letter A indicates the current breaking capacity of the conventional alloy (consisting of Cu-25 Cr). As seen from the graphical representation, when the adding quantity of Ti is 0.5% by weight for the respective Ta contents, there appears a peak in the current breaking capacity, which indicates improvement in the current breaking capability by addition of Ti. However, when the Ta content becomes 20% by weight and above, the effect of Ti diminisihes, and, rather, decrease in current breaking capability takes place. Further, the effect to be derived from addition of Ti is remarkable as the Ta content is small. More concretely, when 0.5% by weight of Ti is added with respect to 1% by weight of Ta, the alloy exhibits its current breaking capacity of 1.5 times as large as that of the conventional alloy (consisting of Cu-25 wt. % Cr). Also, when the Ta content is 10% by weight, the alloy attains its current breaking capacity of 1.9 times as high as that of the conventional alloy by addition of 0.5% by weight of Ti. In other words, when the Ta content is relatively small, alloy and compound to be produced by appropriate reaction between Ti and other elements disperse uniformly and minutely to remarkably increase the current breaking capability, and yet the Cu content is sufficient to maintain the electrical conductivity and heat conductivity without lowering them, so that the heat input due to electric arc can be quickly dissipated. However, when the Ta content increases, the Cu content decreases inevitably, so that, even if the compound itself to be produced by the reaction between Cu and Ti has a function of increasing the current breaking capability, its adverse effect of lowering the electrical conductivity and heat conductivity becomes overwhelming, whereby the factors for improving the current breaking capability to be brought about by the reaction between Ti and other elements are overcome and, as a whole, the current breaking capability does not appear improve. Also, with the same Ta content, when the Ti content exceeds an appropriate quantity to exhibit its effect, the electrical conductivity and the heat conductivity also lower remarkably, which is not favorable. From the standpoint of the currnet breaking capability, the adding quantity of Ti should most preferably be 0.5% by weight for the respective Ta contents. In passing, it should be noted that the Cu-Cr-Ta-Ti alloy used in this experiment was obtained by shaping and sintering a mixture powder of Cu, Cr, Ta and Ti at a required quantity for each of them.

FIG. 15 indicates a relationship between the current breaking capacity and the Ta content added to the alloy for the contact material, wherein the Cr content is fixed at 25% by weight, and the Ti content is fixed at 0, 0.5, 1.0, 1.5, 3 and 5% by weight, respectively. In the drawing, the ordinate denotes a ratio when the current breaking capacity of the conventional alloy (consisting of Cu-25 wt. % Cr) is made 1, and the abscissa denotes the adding quantity of Ta. As seen from FIG. 15, it is with 20% by weight or below of Ta added that the increased effect in the current breaking capacity can be observed by the addition of Ti at a rate of 0.5% by weight. On the other hand, the adding quantity of Ti may still be effective in a range of 5% by weight or below, in case the Ta content is very small (1% by weight or so). However, when it exceeds 3% by weight, the contact resistance tends to increase, hence its adding quantity should preferably by 3% by weight or below depending on the conditions of use of the alloy. It is also in a range of 5% by weight or below of the Ta content that the desired effect can be observed with the Ti content is 1.0% by weight, and it is in a range of 3% by weight or below of the Ta content that the desired effect can be observed with the Ti content of of 1.5% by weight. On the other hand, if the Ti content exceeds 2% by weight, the effect of the current breaking capability can be observed, only when the Ta content is 1% by weight or so. In contrast to these, with the Ti content being in a range of 0.5% by weight or below, there emerges an improved effect in the current breaking capability over the broadest range of the Ta content, i.e., an range of 20% by weight or below.

From the abovementioned results, ranges of 0.8% by weight or below of Ti and 3.5 to 18% by weight of Ta are preferably for further improvement in the current breaking capability of the ternary alloy of Cu-Cr-Ta by addition of Ti thereto. Further, as the condition for obtaining the excellent current breaking capability by reducing the adding quantity of Ta as much as possible, a range of the Ta content of 15% by weight or below is desirable.

The present inventors conducted experiements as shown in FIGS. 14 and 15 by varying the Cr content. With the Cr content in a range of from 10 to 35% by weight, there could be observed improvement in the current breaking capability due to addition of Ti, while, with the Cr content in a range of 10% by weight or less, there took place no change in the current breaking capability even by addition of Ti. Conversely, when the Cr content exceeds 35% by weight, there takes place lowering of the current breaking capability.

On the other hand, the contact material made of the Cu-Cr-Ta-Ti series alloy containing Cr in a range of from 10 to 35% by weight, Ta in a range of 20% by weight or less, and Ti in a rnage of 5% by weight or less is not inferior in its contact resistance to the conventional alloy (consisting of Cu-25 wt. % Cr) and is also satisfactory in its voltage withstand capability, which, though not shown in the drawing, have been verified from various experiments.

It has also been verified, though not shown in the drawing, that the current breaking property can be effectively increased in the same manner as in the above-described embodiments even in the contact material for a low chopping, vacuum circuit breaker made of an alloy added with 20% by weight or less of at least one kind of the low melting point metals such as Bi, Te, Sb, Tl, Pb, Se, Ce and Ca, and at least one kind of their alloys, their intermetallic compounds, and their oxides.

Incidentally, when at least one kind of the low melting point metals, their alloys, their intermetallic compounds, and their oxides is added to the alloy in an amount of 20% by weight and above, the current breaking capability of the alloy decreased remarkably. Moreover, in the case of the low melting point metal being Ce or Ca, the charactersitics of the alloy are somewhat inferior.

In this second embodiment of the present invention, explanations have been made in terms of the Cu-Cr-Ta-Ti alloy. It should, however, be noted that the expected object can be achieved, even when each element in the alloy is distributed therein as a single substance, a binary, ternary or quaternary alloy, a binary, ternary or quaternary intermetallic compound, or a composite body of these.

As mentioned in the foregoing, the second embodiment of the present invention is characterized in that the alloy for the contact material consists essentially of copper, 10 to 35% by weight of chromium, 20% by weight or below of tantalum, and 5% by weight or below of titanium. Therefore, the invention has its effect such that the contact material for the vacuum circuit breaker excellent in its current breaking capability and having satisfactory voltage withstand capability can be obtained even if the Ta content is reduced. Furthermore, when the Ta content is limited to a range of from 3.5 to 18% by weight, and the Ti content to a range of 0.8% by weight or below, the current breaking capability improves much more than in the case where no Ti is added.

The third embodiment of the present invention will now be explained hereinbelow in reference to FIGS. 16 and 17. In this embodiment, a Cu-Cr-Ta-Al series alloy material is used as the contact material for the electrodes 4 and 5 shown in FIG. 1.

FIG. 16 indicates a relationship between the current breaking capacity and the Al content added to the alloy, in which the Cr content is fixed at 25% by weight and the Ta content is fixed at 0, 1, 5, 10, 15, 20 and 25% by weight, respectively.

In the graphical representation of FIG. 16, the ordinate denotes a ratio when the current breaking capacity of conventional alloy (Cu-25 wt. % Cr) is made 1, and the abscissa denotes the adding quantity of Al. In FIG. 16, a reference letter A represents the current breaking capacity of the conventional alloy (Cu-25 wt. % Cr). As seen from the graphical representation, when the adding quantity of Al is 0.6% by weight for the respective content of Ta, there appears a peak in the current breaking capacity. Further improvement is seen in the current breaking capability by addition of Al. However, when the quantity of Ta is 20% by weight or above, the effect to the derived from addition of Al becomes diminished, and, rather, there takes place decrease in the current breaking capability. Also, the effect to be derived from addition of Al becomes much more effective as the quantity of Ta is smaller. When 0.6% by weight of Al is added with respect to 1% by weight of Ta, the current breaking capacity becomes 1.35 times as high as that of the conventional alloy. Further, when the quantity of Ta is 10% by weight, there can be obtained the current breaking capacity of 1.85 times or more as high as that of the conventional alloy by addition of 0.6% by weight of Al thereto. That is to say, when the quantity of Ta is relatively small, alloy and compound to be produced by appropriate reaction of Al with other elements are uniformly and minutely dispersed in the alloy to remarkably increase the current breaking capability thereof, and yet the quantity of Cu is so sufficient as to maintaining the electrical conductivity and the heat conductivity of the alloy, hence the heat input due to electrical arc can be quickly dissipated. When the quantity of Ta becomes increased, however, the quantitative ratio of Cu becomes inevitably lowered, so that, even if the compound itself to be produced by the reaction between Cu and Al has a function of increasing the current breaking capability, its adverse effect of lowering the electrical conductivity and the heat conductivity becomes overwhelming, with the consequence that the factors for improving the current breaking capability to be brought about by the reaction between Al and other elements are overcome and, as a whole, the current breaking capability does not appear to improve. Also, with the same quantity of Ta when the quantity of Al exceeds an appropriate quantity to exhibit its effect, the electrical conductivity and the heat conductivity also lower remarkably, which is not favorable. Also, from the standpoint of the current breaking capability, the adding quantity of Al should most preferably be 0.6% by weight for the respective quantities of Ta. In passing, it should be noted that the Cu-Cr-Ta-Al alloy used in this experiment was obtained by shaping and sintering a mixture powder of Cu, Cr, Ta and Al at a required quantity for each of them.

Incidentally, the ordinate in the graphical representation of FIG. 16 represents a ratio when the current breaking capacity of the conventional alloy (Cu-25 wt. % Cr) is made 1, and the abscissa thereof represents the adding quantity of Al. In FIG. 16, a reference letter A indicates the current breaking capacity of the conventional alloy (Cu-25 wt. % Cr).

FIG. 17 indicates a relationship between the current breaking capacity and the quantity of Ta, when the Cr content in the alloy for the contact material is fixed at 25% by weight and the Al content is fixed at 0, 0.6, 1.0, 1.5 and 3.0% by weight, respectively. In the drawings, the ordinate denotes a ratio when the current breaking capacity of the conventional alloy (consisting of Cu-25 wt. % Cr) is made 1, the the abscissa denotes the adding quantity of Ta. As seen from FIG. 17, it is with 20% by weight or below of the qauntity of Ta added that the increased effect in the current breaking capacity can be observed over the broadest range by addition of Ta when the quantity of Al is 0.6% by weight. On the other hand, the adding quantity of Al may still be effective in a range of 3% by weight or below, when the quantity of Ta is very samll (2% by weight or below). However, when it exceeds 3% by weight, the current breaking capability, the contact resistance, and so forth undesirably decrease.

From the abovementioned results, it is desirable that Al be in a range of 0.8% by weight or below, and the quantity of Ta be in a range of from 5 to 18% by weight for further improvement in the current breaking capability of the ternary alloy of Cu-Cr-Ta by addition of Al thereto. Further, as the condition for obtaining the excellent current breaking capability by reducing the adding quantity of Ta as far as possible, the quantity of Ta should desirably be in a range of 15% by weight or below.

The present inventors conducted experiments as shown in FIGS. 16 and 17 by varying the quantity of Cr. With the quantity of Cr being in a range of from 10 to 35% by weight, there could be observed improvement in the current breaking capability due to addition of Al. With the quantity of Cr being in a range of 10% by weight or below, there took place no change in the current breaking capability even by addition of Al. Conversely, when the quantity of Cr exceeds 35% by weight, there takes place lowering of the current breaking capability.

On the other hand, the contact material made of the Cu-Cr-Ta-Al series alloy containing Cr in a range of from 10 to 35% by weight, Ta in a range of 20% by weight or below, and Al in a range of 3% by weight or below is not inferior in its contact resistance to the conventional alloy (consisting of Cu-25 wt. % Cr) and has as good a voltage withstand capability as that of the conventional alloy, which have been verified from various experiments, though not shown in the drawing.

It has also been verified, though not shown in the drawing, that the current breaking property can be effectively increased in the same manner as in the above-described embodiments even in the contact material for a low chopping, vacuum circuit breaker made of an alloy added with 20% by weight or below of at least one kind of the low melting point metals such as Bi, Te, Sb, Tl, Pb, Se, Ce and Ca, and at least one kind of their alloys, theri intermetallic compounds, and their oxides.

Incidentally, when at least one kind of the low melting point metals, their alloys, their intermetallic compouonds, and their oxides is added to the alloy in an amount of 20% by weight and above, the current breaking capability of the alloy decreased remarkably. Moreover, in the case of the low melting point metal being Ce or Ca, the characteistics of the alloy are somewhat inferior.

In this third embodiment of the present inventinon, explanations have been made in terms of the Cu-Cr-Ta-Al alloy. However, it is apparent that the expected object can be achieved, even when each element in the alloy is distributed therein as a single substance, a binary, ternary or quaternary alloy, a binary, ternary or quaternary intermetallic compouond, or a composite body of these.

As mentioned in the foregoing, the third embodiment of the present invention is characterized in that the alloy for the contact material consists essentially of copper, 10 to 35% by weight of chromium, 20% by weight or below of tantalum, and 3% by weight or below of aluminum. Therefore, the present invention has its effect such that the contact material for the vacuum circuit breaker excellent in its current breaking capability and having satisfactory voltage withstand capability can be obtained even if the quantity of Ta is reduced. Furthermore, when the quantity of Ta is limited to a range of from 5 to 18% by weight, and the quantity of Ti to a range of 0.8% by weight or below, the current breaking capability improves much more than in the case where no Ti is added.

The fourth embodiment of the present invention will now be explained hereinbelow in refernce to FIGS. 18 and 19. In this embodiment, a Cu-Cr-Ta-Zr series alloy material is used as the contact material for the electrodes 4 and 5 shown in FIG. 1.

FIG. 18 indicates a relationship between the current breaking capacity and the Zr content added to the alloy, in which the Cr content is fixed at 25% by weight and the quantity of Ta is fixed at 0, 1, 5, 10, 15, 20 and 25% by weight, respectively. In the graphical representation of FIG. 18, the ordinate represents a ratio when the current breaking capacity of a conventional alloy (Cu-25 wt. % Cr) is made 1, and the abscissa denotes the adding quantity of Zr. In FIG. 18, a reference letter A indicates the current breaking capacity of the conventional alloy (Cu-25 wt. % Cr). As seen from the graphical representation, when the adding quantity of Zr is 0.4 by weight for the respective quantities of Ta, there appears a peak in the current breaking capacity, from which further improvement is seen in the current breaking capability by addition of Zr. However, when the quantity of Ta becomes 20% by weight or above, the effect to be derived form addition of Zr is diminished, and, rather, there takes place decrease in the current breaking capability. Also, the effect to be derived from addition of Zr becomes much more remarkable as the quantity of Ta is smaller. When 0.5% by weight of Zr is added with respect to 1% by weight of Ta, the current breaking capacity becomes 1.35 times as high as that of the conventional alloy (Cu-25 wt. % Cr). Further, when the quantity of Ta is 10% by weight, there can be obtained the current breaking capacity of nearly 1.9 times as high as that of the conventional alloy by addition of 0.5% by weight of Zr thereto. That is to say, when the quantity of Ta is relatively small, those alloy and compound to be produced by appropriate reaction of Zr with other elemets are uniformly and minutely dispersed in the alloy to remarkably increase the current breaking capability thereof, and yet the quantity of Cu is so sufficient as to maintaining the electrical conductivity and the heast conductivity of the alloy, hence the heat input due to electrical arc can be quickly dissipated. However, when the quantity of Ta becomes increased, the quantitative ratio of Cu becomes inevitably lowered, so that, even if the compound itself to be produced by the reaction between Cu and Zr has a function of increasing the current breaking capability, its adverse effect of lowering the electrical conductivity and the heat conductivity becomes overwhelming, with the consequence that the factors for improving the current breaking capability to be brought about by the reaction between Zr and other elements are overcome, and, as a whole, the current breaking capability does not appear to improve. Also, with the same quantity of Ta, when the quantity of Zr exceeds an appropriate quantity to exhibit its effect, the electrical conductivity and the heat conductivity also lower remarkably, which is not favorable. Furhter, from the standpoint of the current breaking capability, the adding quantity of Zr should most preferalby be 0.4% by weight for the respective quantities of Ta. In passing, it should be noted that the Cu-Cr-Ta-Zr alloy used in this experiment was obtained by shaping and sintering a mixture powder of Cu, Cr, Ta and Zr at a required quantity for each of them.

Incidentally, the ordinate in the graphical representation of FIG. 18 denotes a ratio when the current breaking capacity of the conventional alloy (Cu-25 wt. % Cr) is made 1, and the abscissa denotes the adding quantity of Zr. In FIG. 18, a reference letter A indicates the current breaking capacity of the conventional alloy (Cu-25 wt. % Cr).

FIG. 19 shows a relationship between the current breaking capacity and the quantity of Ta, when the Cr content in the alloy for the contact material is fixed at 25% by weight and the Zr content is fixed at 0, 0.4, 1.0 and 2.0% by weight, respectively. In the drawing, the ordinate represents a ratio when the current breaking capacity of the conventional alloy (consisting of Cu-25 wt. % Cr) is made 1, and the abscissa represents the adding quantity of Ta. As seen from FIG. 19, it is with 20% by weight or below of the quantity of Ta added that the increased effect in the current breaking capacity can be observed most eminently by addition of Zr, when the quantity of Zr is 0.4% by weight. On the other hand, the adding quantity of Zr may still be effective in a range of 2% by weight, when the quantity of Ta is very small (2% by weight or below). However, when it exceeds 2% by weight, the current breaking capability, the contact resistance, and so forth unfavorably decrease.

From the abovementioned results, it is desirable that the quantity of Zr be in a range of 0.65% by weight or below and the quantity of Ta be in a range of from 4.5 to 18% by weight for further improvement in the current breaking capability of the ternary alloy of Cu-Cr-Ta by addition of Ti thereto. Moreover, as the condition for obtaining the excellent current breaking capability by reducing the adding quantity of Ta as much as possible, the quantity of Ta should desirably be in a range of 15% by weight or below.

The present inventors conducted experiments as shown in FIGS. 18 and 19 by varying the quantity of Cr. With the quantity of Cr being in a range of 10 to 35% by weight, there could be observed improvement in the current breaking capability by the addition of Ti. However, with the quantity of Cr being in a range of 10% by weight or below, there could be seen no change in the current breaking capability even by addition of Ti. Conversely, when the quantity of Cr exceeds 35% by weight, there takes place lowering of the current breaking capability.

On the other hand, the contact material made of the Cu-Cr-Ta-Zr series alloy containing Cr in a range of from 10 to 35% by weight, Ta in a range of 20% by weight or below, and Zr in a range of 2% by weight or below is not inferior in its contact resistance to the conventional alloy (consisting of Cu-25 wt. % Cr) and has as good a voltage withstand capability as that of the conventional alloy, which have been verified from various experiments, though not shown in the drawing.

It has also been verified, though not shown in the drawing, that the current breaking property can be effectively increased in the same manner as in the above-described embodiments even in the contact material for a low chopping, vacuum circuit breaker made of an alloy added with 20% by weight or below of at least one kind of the low melting point metals such as Bi, Te, Sb, Tl, Pb, Se, Ce and Ca, and at least one kind of their alloys, their intermetallic compounds and their oxides.

Incidentally, when at least one kind of the low melting point metals, their alloys, intermetallic compounds, and their oxides is added to the alloy in an amount of 20% by weight and above, the current breaking capability of the alloy descreased remarkably. Moreover, in the case of the low melting point metal being Ce or Ca, the characteristics of the alloy are somewhat inferior.

In this fourth embodiment of the present invention, explanations have been made in terms of the Cu-Cr-Ta-Zr alloy. It is apparent, however, that the expected objective can be achieved, even when each element of the alloy is distributed there in as a single substance, a binary, ternary or quaternary alloy, a binary, ternary or quaternary intermetallic compound, or a composite body of these.

As mentioned in the foregoing, the fourth embodiment of the present invention is characterized in that the alloy for the contact material consists essentially of copper, 10 to 35% by weight of chromium, 20% by weight or below of tantalum, and 2% by weight or below of zirconium. Therefore, the present invention has its effect such that the contact material for the vacuum circuit breaker excellent in its current breaking capability and having satisfactory voltage withstand capability can be obtained, even if the quantity of Ta is reduced. Furthermore, when the quantity of Ta is limited to a range of from 4.5 to 18% by weight, and the quantity of Zr to a range of 0.65% by weight or below, the current breaking capability improves much more than in the case where no Ti is added.

We claim:

1. A contact material for a vacuum circuit breaker which consists essentially of copper as the basic component, and, as the other component, an amount of chromium between 0.0 and up to 35% weight and an amount of tantalum between 0.0 and up to 50% weight, the total quantity of chromium and tantalum in said contact material being 10% by weight and above.

2. The contact materiaL for a vacuum circuit breaker according to claim 1, wherein the total quantity of chromium and tantalum is in a range of 65% by weight or below.

3. The contact material for a vacuum circuit breaker according to claim 1, wherein chromium is in a range of from 5 to 30% by weight, and tantalum is in a range of from 5 to 30% by weight.

4. The contact material for a vacuum circuit breaker according to claim 1, wherein copper, chromium and tantalum are distributed therein in the form of a single metal or as at least one kind of a ternary alloy of these metals, a binary alloy of these metals, a ternary intermetallic compound of these metals, a binary intermetallic compound of these metals, and a composite body of these.

5. The contact material for a vacuum circuit breaker according to claim 1, further containing 20% by weight or below of at least one kind of low melting point metals selected from the group consisting of bismuth, tellurium, antimony, thallium, lead, selenium, cerium, and calcium, and at least one kind of alloys and intermetallic compounds of said low melting point metals.

6. A contact material for a vacuum circuit breaker which consists essentially of copper as the basic component, and, as the other component, 10–35% by weight of chromium, an amount of tantalum between 0.0 and up to 20% weight and up to 5% by weight of titanium.

7. The contact material for a vacuum circuit breaker according to claim 6, wherein the quantity of titanium is 3% by weight or below.

8. The contact material for a vacuum circuit breaker according to claim 6, wherein the quantity of titanium is 0.8% by weight or below.

9. The contact material for a vacuum circuit breaker according to claim 6, wherein tantalum is in the range of from 3.5 to 18% by weight, and titanium is in the range of from 0.8% by weight or below.

10. The contact material for a vacuum circuit breaker according to claim 6, wherein tantalum is in the range of from 3.5 to 15% by weight, and titanium is in the range of 0.8% by weight or below.

11. A contact material for a vacuum circuit breaker which consists essentially of copper as the basic component, and, as the other components, 10 to 35% by weight of chromium, an amount of tantalum between 0.0 and up to 20% weight and 3% by weight or of aluminum.

12. The contact material for a vacuum circuit breaker according to claim 11, wherein aluminum is in a range of 0.8% by weight or below.

13. The contact material for a vacuum circuit breaker according to claim 11, wherein tantalum is in the range of from 5 to 18% by weight.

14. The contact material for a vacuum circuit breaker according to claim 11, wherein tantalum is in the range of from 5 to 15% by weight.

15. The contact material for a vacuum circuit breaker according to claim 11, further containing 20% by weight or below of at least one kind of low melting metals selected from the group consisting of bismuth, tellurium, antimony, thallium, lead, selenium, cerium, and calcium, and at least one kind of alloys, intermetallic compounds, and oxides of said low melting point metals.

16. A contact material for a vacuum circuit breaker which consists essentially of copper as the basic component, and, as the other components, 10 to 35% by weight of chromium, an amount of tantalum between 0.0 and up to 20% weight and 2% by weight or below of zirconium.

17. The contact material for a vacuum circuit breaker according to claim 16, wherein zirconium is in the range of 0.65% by weight or below.

18. The contact material for a vacuum circuit breaker according to claim 16, wherein tantalum is in the range of from 4.5 to 18% by weight or below.

19. The contact material for a vacuum circuit breaker according to claim 16, wherein tantalum is in the range of from 4.5 to 15% by weight or below.

20. The contact material for a vacuum circuit breaker according to claim 16, further containing 20% by weight or below of at least one kind of low melting point metals selected from the group consisting of bismuth, tellurium, antimony, thallium, lead, selenium, cerium, and calcium, and at least one kind of alloys, intermetallic compounds, and oxides of said low melting point metals.

* * * * *